US007544098B2

(12) United States Patent
Nakamura

(10) Patent No.: US 7,544,098 B2
(45) Date of Patent: Jun. 9, 2009

(54) CONNECTOR HAVING A STOPPER MECHANISM DEFINING A MOVABLE RANGE OF A HOUSING RECEIVING A CONNECTION OBJECT

(75) Inventor: Keisuke Nakamura, Tokyo (JP)

(73) Assignee: Japan Aviation Electronics industry, Limited, Tokyo (JP)

( * ) Notice: Subject to any disclaimer, the term of this patent is extended or adjusted under 35 U.S.C. 154(b) by 0 days.

(21) Appl. No.: 11/904,960

(22) Filed: Sep. 28, 2007

(65) Prior Publication Data

US 2009/0004901 A1 Jan. 1, 2009

(30) Foreign Application Priority Data

Jun. 29, 2007 (JP) ..... 2007-172727

(51) Int. Cl.
*H01R 24/00* (2006.01)

(52) U.S. Cl. ..... 439/630; 439/248

(58) Field of Classification Search ..... 439/247, 439/248, 495, 496, 497
See application file for complete search history.

(56) References Cited

U.S. PATENT DOCUMENTS 5,755,584 A 5/1998 Kodama et al.
6,733,325 B2 * 5/2004 Sakai et al. ..... 439/495
7,204,707 B2 * 4/2007 Kawase et al. ..... 439/247
2006/0019520 A1 * 1/2006 Kawase et al. ..... 439/247

FOREIGN PATENT DOCUMENTS

| | | |
|---|---|---|
| JP | 63-202086 | 12/1988 |
| JP | 05-023465 | 3/1993 |
| JP | 6-163125 | 6/1994 |
| JP | 7-335342 | 12/1995 |
| JP | 9-223552 | 8/1997 |
| JP | 10-326654 | 8/1998 |
| JP | 2006-59788 | 2/2006 |

OTHER PUBLICATIONS

Japanese Office Action dated Jan. 9, 2008 with English translation of relevant portions.
Japanese Office Action dated May 7, 2008.

* cited by examiner

*Primary Examiner*—Neil Abrams
*Assistant Examiner*—Phuong Nguyen
(74) *Attorney, Agent, or Firm*—Collard & Roe, P.C.

(57) ABSTRACT

In a connector adapted to be connected to and disconnected from a connection object in connecting and disconnecting directions, the connector includes a first housing for receiving the connection object and a second housing holding the first housing so that the first housing is three-dimensionally movable. A contact is held by the first and the second housings. The second housing includes a stopper mechanism three-dimensionally defining a movable range of the first housing.

8 Claims, 5 Drawing Sheets

CONNECTOR HAVING A STOPPER MECHANISM DEFINING A MOVABLE RANGE OF A HOUSING RECEIVING A CONNECTION OBJECT

This application is based upon and claims the benefit of priority from Japanese patent application No. 2007-172727, filed on Jun. 29, 2007, the disclosure of which is incorporated herein in its entirety by reference.

BACKGROUND OF THE INVENTION

This invention relates to a so-called floating-type connector.

For example, a connector of the type is disclosed in Japanese Unexamined Patent Application Publication (JP-A) No. 2006-59788. The connector has a fitting portion movable in connecting and disconnecting directions. The fitting portion is fixed until it is completely fitted to a connection object. After the fitting portion is completely fitted to the connection object, the fitting portion is allowed to be moved in the connecting and the disconnecting directions. However, if the fitting portion is excessively moved while it is fitted to the connection object, a contact may excessively be deformed to cause plastic deformation. Therefore, the above-mentioned connector is poor in operability of connection and low in reliability.

Japanese Unexamined Patent Application Publication (JP-A) No. H10-326654 discloses a connector comprising a first housing mounted on a printed board, a second housing separate from the first housing, and a plurality of flexible contacts held between the first and the second housings. In this connector, the second housing is movable with respect to the first housing because of flexibility of the flexible contacts. However, like in the foregoing, if the second housing is excessively moved with respect to the first housing, the flexible contacts may excessively be deformed to cause plastic deformation. Therefore, this connector is also poor in operability and low in reliability.

SUMMARY OF THE INVENTION

It is therefore an exemplary object of this invention to provide a floating-type connector rich in operability of connection and high in reliability.

Other objects of the present invention become clear as the description proceeds.

According to an exemplary aspect of the present invention, there is provide a connector adapted to be connected to and disconnected from a connection object in connecting and disconnecting directions, the connector comprising a first housing for receiving the connection object, a second housing holding the first housing so that the first housing is three-dimensionally movable, and a contact held by the first and the second housings, wherein the second housing includes a stopper mechanism three-dimensionally defining a movable range of the first housing.

DESCRIPTION OF THE EXEMPLARY EMBODIMENTS

Figure 1:
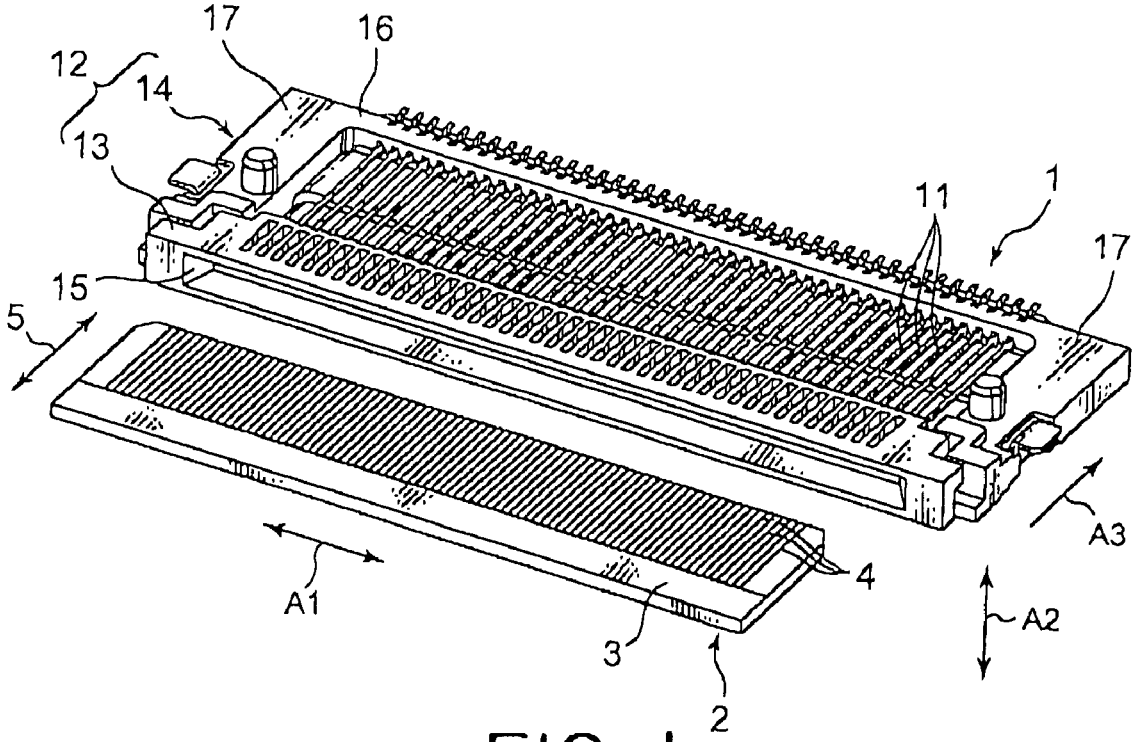
FIG. 1 is a perspective view of a connector according to a first exemplary embodiment of this invention, together with a connection object.
Figure 2:
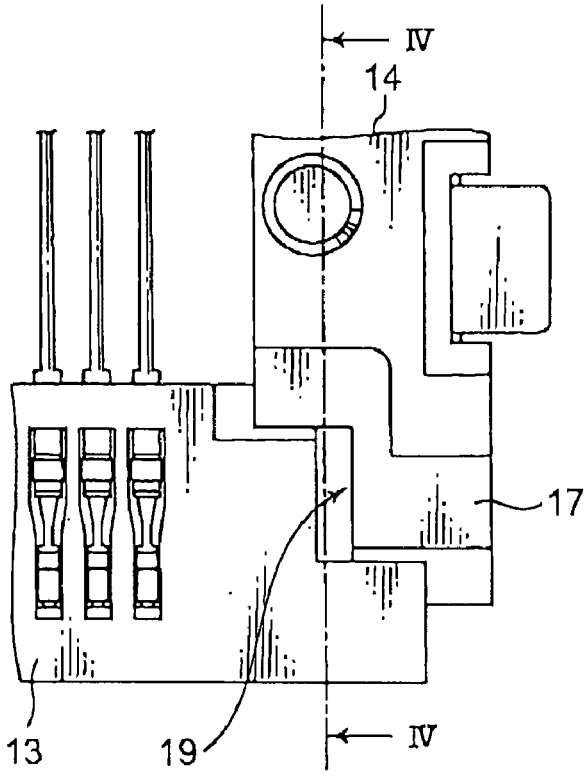
FIG. 2 is a plan view of a part of the connector in FIG. 1.
Figure 3:
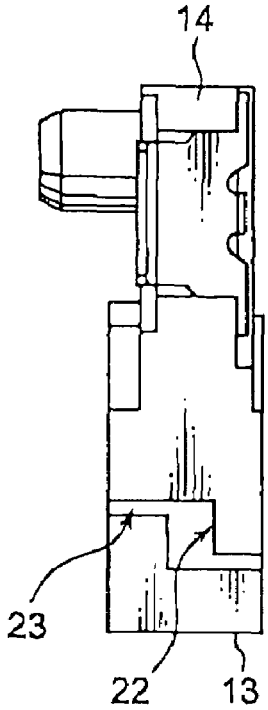
FIG. 3 is a side view of the connector in FIG. 1.
Figure 4:
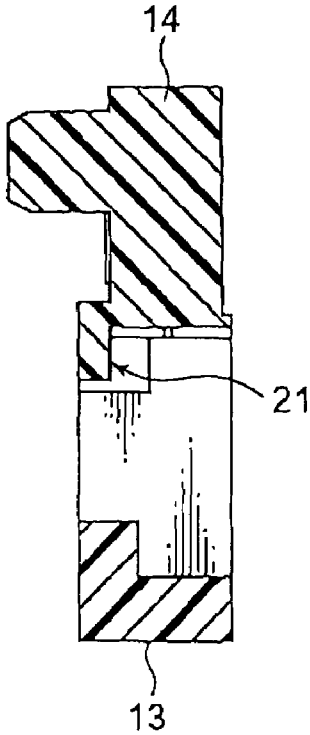
FIG. 4 is a sectional view taken along a line IV-IV in FIG. 2.

Referring to FIGS. 1 to 5, description will be made of a connector according to a first exemplary embodiment of this invention, together with a connection object.

The connector depicted at 1 in the figures is adapted to be fitted and connected to an edge portion of a card 2 as an example of the connection object and, therefore, will be called a card edge connector. The card 2 comprises an insulating card board 3 and a number of conductive contacts 4 formed on one surface of the card board 3 and arranged along one edge in parallel to one another. The card 2 is moved in fitting and removing directions (connecting and disconnecting directions) 5 to be fitted to and removed from the card edge connector 1.

The card edge connector 1 comprises a number of conductive contacts 11 and a housing 12 holding the contacts 11. The housing 12 comprises an insulating first housing (front housing) 13 and an insulating second housing (rear housing) 14 separate from the first housing 13. The first housing 13 extends in a first direction A1 perpendicular to the fitting and the removing directions 5 and has a fitting hole 15 formed on an outward-facing surface (front surface) in the fitting and the removing directions 5 and extending long in the first direction A1 to receive the edge portion of the card 2.

The second housing 14 has a main portion 16 extending in parallel to the first housing 13 and a pair of side portions 17 perpendicularly bent from opposite ends of the main portion 16 and extending frontward. The side portions 17 holds the first housing 13 so that the first housing 13 is three-dimensionally movable. Specifically, the first housing 13 is movable with respect to the second housing 14 in the fitting and the removing directions 5, the first direction A1, and a second direction A2 perpendicular to the fitting and the removing directions 5 and the first direction A1.

Further, the second housing 14 has a stopper mechanism three-dimensionally defining a movable range of the first housing 13. The stopper mechanism comprises a left/right stopper 19, an upward stopper 21, a downward stopper 22, and a rearward stopper 23 which are provided at each of the side portions 17. The left/right stopper 19 serves as a first stopper for restricting the movement of the first housing 13 in the first direction A1. A combination of the upward and the downward stoppers 21 and 22 serves as a second stopper for restricting the movement of the first housing 13 in the second direction A2. The rearward stopper 23 serves as a third stopper for restricting the movement of the first housing 13 in a third direction A3 as one of the fitting and the removing directions along which a pressing force of the card 2 is applied.

On the other hand, each contact 11 has a contacting portion 26 held by the first housing 13, a terminal portion 27 held by the second housing 14, and a coupling portion 29 integrally coupling the contacting portion 26 and the terminal portion 27. A part of the contacting portion 26 is disposed in the fitting hole 15 and is adapted to be contacted with the corresponding contact 4 of the card 1 when the card 2 is inserted into the fitting hole 15. A part of the terminal portion 27 is exposed rearward from the second housing 14 and is adapted to be connected to a connection object, such as a circuit board, by soldering.

Figure 5:
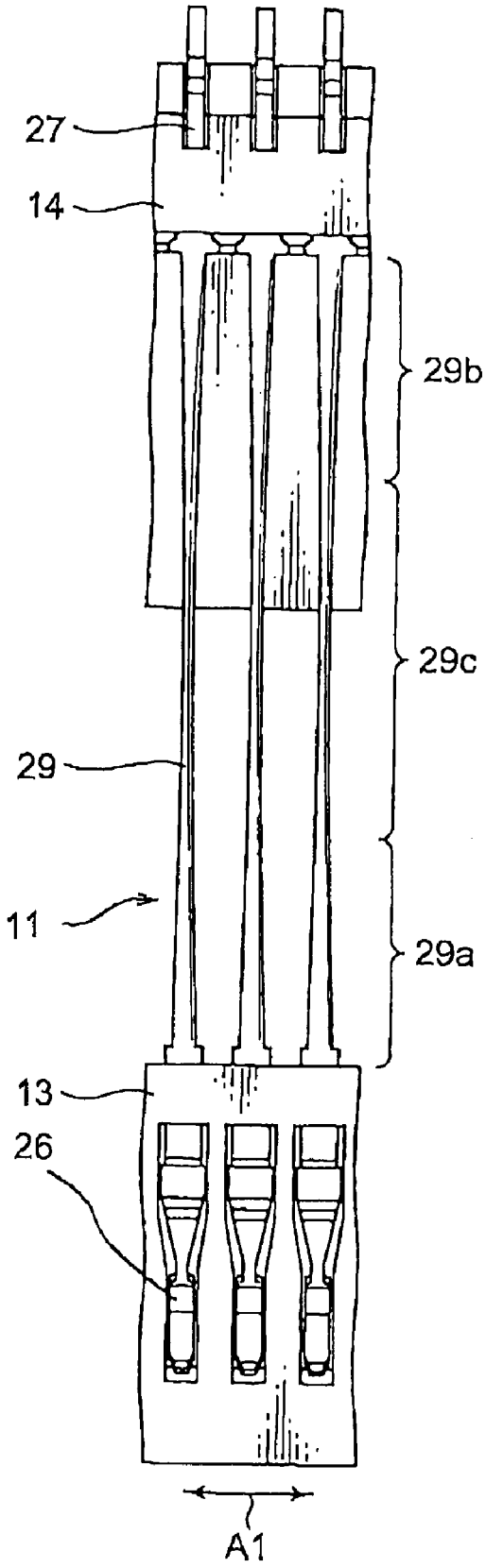
FIG. 5 is an enlarged plan view for describing a characteristic part of the connector in FIG. 1.

As is clear from FIG. 5, the coupling portion 29 of each contact 11 has a neighboring portion 29*a* near the contacting potion 26, a neighboring portion 29*b* near the terminal portion 27, and an intermediate portion 29*c* between the neighboring portions 29*a* and 29*b*. The intermediate portion 29*c* is narrower in width than each of the neighboring portions 29*a* and 29*b*. Specifically, each of the neighboring portion 29*a* near the contacting portion 26 and the neighboring portion 29*b* near the terminal portion 27 is tapered to be gradually narrower in width towards the intermediate portion 29*c*. Each of the neighboring portions 29*a* and 29*b* has opposite sides which define its width. The opposite sides may be rectilinear or curvilinear.

When the card 2 is inserted into the fitting hole 15 of the card edge connector 1 mentioned above, the card 2 is electrically connected to the card edge connector 1 with three-dimensional movement of the first housing 13 as necessary. At this time, since the movable range of the first housing 13 is three-dimensionally determined by the stopper mechanism, excessive deformation of the contacts 11 is suppressed. In addition, each contact 11 has a special shape so that an internal stress is dispersed. Therefore, it is possible to reduce the probability of plastic deformation of the contacts 11.

Figure 6:
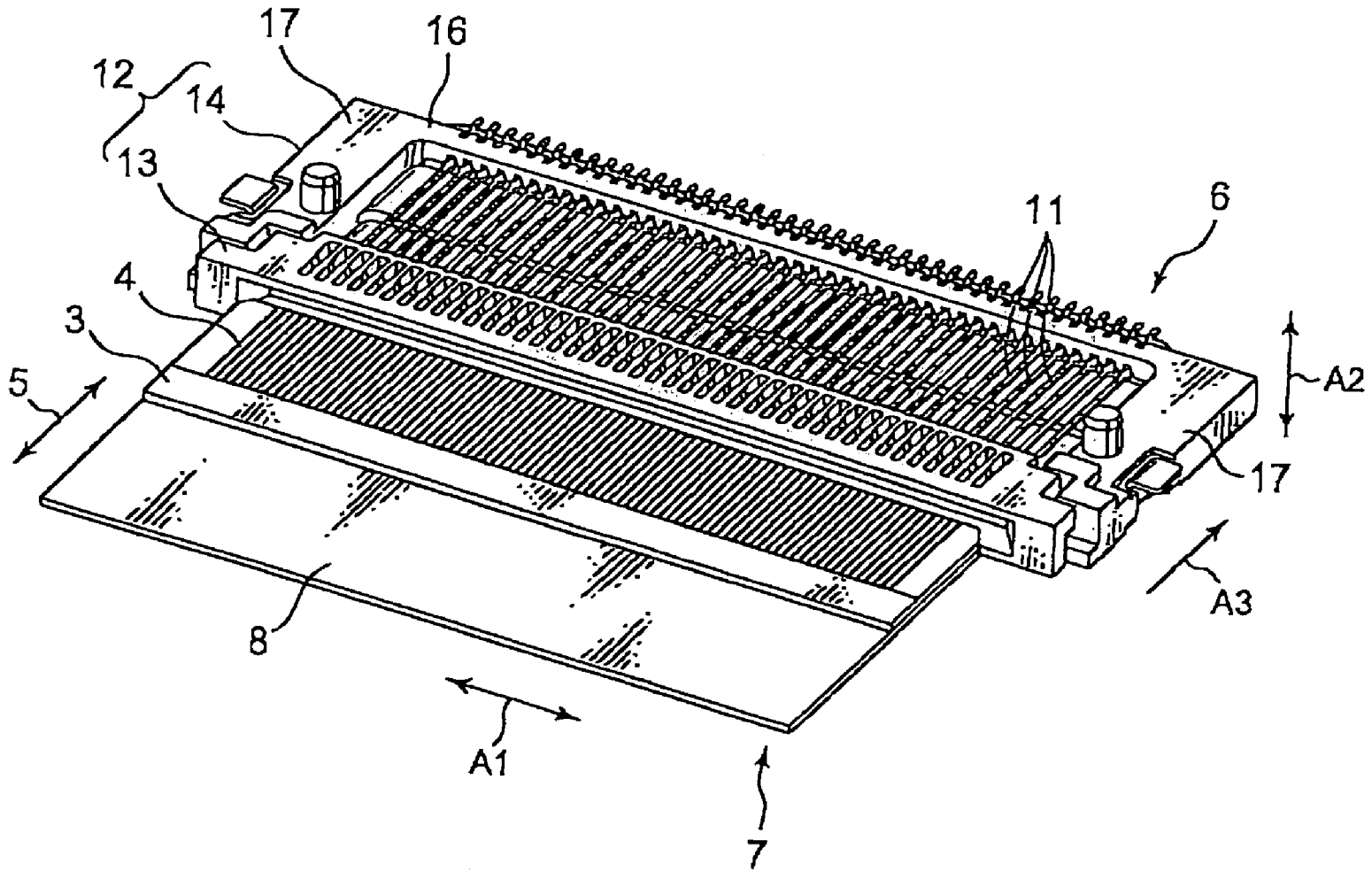
FIG. 6 is a perspective view of a connector according to a second exemplary embodiment of this invention, together with another connection object.
Figure 7:
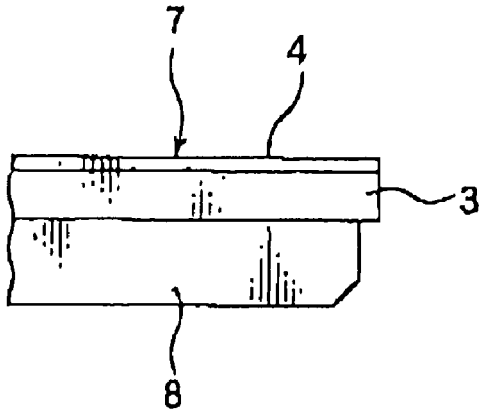
FIG. 7 is a sectional view of a characteristic part of the connection object illustrated in FIG. 6.
Figure 8:
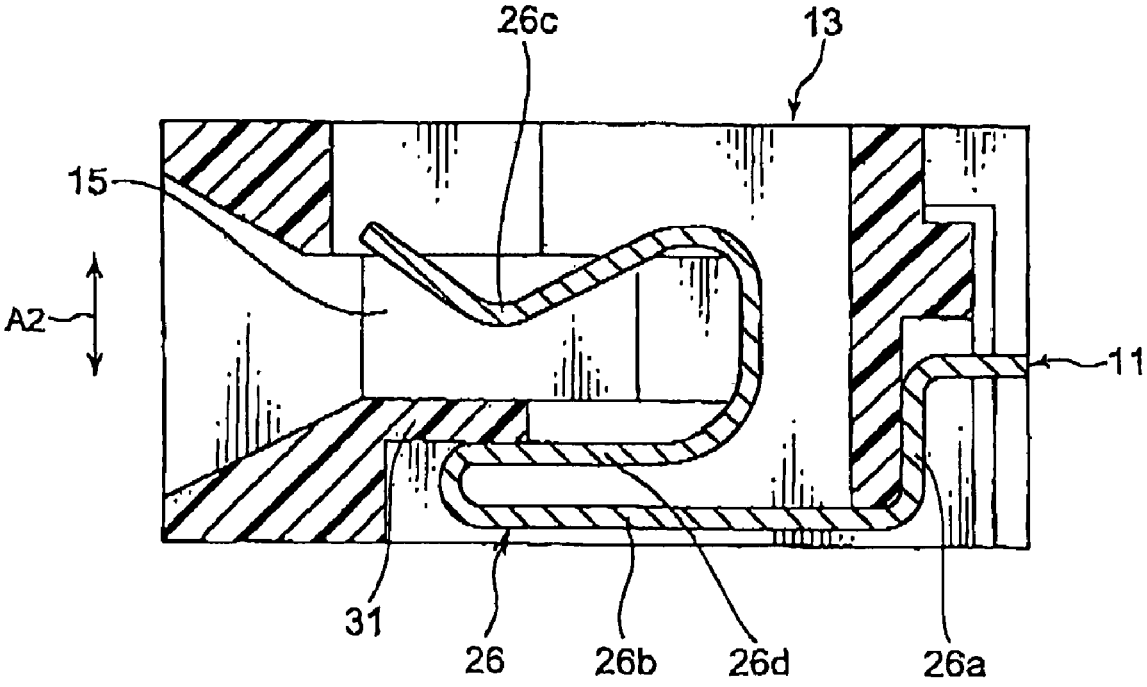
FIG. 8 is a sectional side view of the connector illustrated in FIG. 6.

Referring to FIGS. 6 to 8, description will be made of a connector according to a second exemplary embodiment of this invention, together with another example of the connection object. Similar parts are designated by like reference numerals and description thereof will be omitted.

The connector depicted at 6 in the figures is adapted to be fitted and connected to an edge portion of a card 7 as another example of the connection object and, therefore, will be called a card edge connector also. The card 7 comprises an insulating card board 3 and a number of conductive contacts 4 formed on one surface of the card board 3 and arranged along one edge in parallel to one another, and a metal reinforcing plate 8 attached to the other surface of the card board 3. The card 7 is moved in fitting and removing directions (connecting and disconnecting directions) 5 to be fitted to and removed from the card edge connector 6 in the manner similar to the card edge connector 1 described in connection with FIGS. 1 to 5.

Each contact 11 has a contacting portion 26 including a holding portion 26*a* fixed and held by the first housing 13, a U-shaped spring portion 26*b* extending from the holding portion 26*a*, and a contact point portion 26*c* formed at a part extending from the spring portion 26*b*. The spring portion 26*b* has a turning portion 26*d* formed near the fitting hole 15 of the first housing 13.

When the card 7 is inserted into the fitting hole 15, the contact points 4 of the card 7 are contacted with the contact point portions 26*c* of the contacts 11. At this time, in order to prevent the reinforcing plate 8 of the card 7 from being contacted with the turning portions 26*d* of the contacts 11, the first housing 13 is provided with an insulator 31 formed adjacent the fitting hole 15. As a result, the card 7 is clamped between the contact point portions 26*c* of the contacts 11 and the insulator 31 so that the insulator 31 is strengthened by the reinforcing plate 8 of the card 7. Thus, the reinforcing plate 8 is not contacted with the turning portions 26*d* of the contacts 11 but the contact points 4 alone are contacted with the contact point portions 26*c* of the contacts 11.

The structure of the contacting portion 26 clearly shown in FIG. 8 may be implemented in the card edge connector 1 described in connection with FIGS. 1 to 5.

Although this invention has been described in conjunction with the exemplary embodiments thereof, this invention may be modified in various other manners.

What is claimed is:

1. A connector adapted to be connected to and disconnected from a connection object in connecting and disconnecting directions, the connector comprising:

a first housing including an insulator;

a second housing holding the first housing so that the first housing is three-dimensionally movable; and a contact held by the first and the second housings, wherein the second housing is made of a single member and includes a stopper mechanism three-dimensionally defining a movable range of the first housing, wherein the stopper mechanism comprises:

a first stopper for restricting the movement of the first housing in a first direction perpendicular to the connecting and the disconnecting directions;

a second stopper for restricting the movement of the first housing in a second direction perpendicular to the connecting and the disconnecting directions and the first direction; and a third stopper for restricting the movement of the first housing in a third direction as one of the connecting and the disconnecting directions along which a pressing force of the connection object is applied, wherein the contact comprises:

a contacting portion coupled to the first housing and adapted to be contacted with the connection object;

a terminal portion held by the second housing; and a coupling potion integrally coupling the contacting portion and the terminal portion, wherein the contacting portion comprises:

a holding portion held by the first housing;

a spring portion extending from the holding portion; and a contact point portion connected to the spring portion and facing the insulator to define therebetween an area for receiving the connection object, and wherein the spring portion comprises:

a first U-shaped portion engaged with the insulator; and a turning portion extending continuously between the first U-shaped portion and the contact point portion and turning the insulator to form a second U-shaped portion which is directed opposite to the first U-shaped portion.

2. The connector according to claim 1, wherein the coupling portion is formed to become gradually narrower in width from neighborhoods of the contacting portion and the terminal portion towards an intermediate point between the neighborhoods.

3. The connector according to claim 1, wherein the first housing having a fitting hole formed on an outward-facing surface thereof, and the contacting portion has a part disposed in the fitting hole.

4. The connector according to claim 1, wherein the terminal portion has a part exposed from the second housing.

5. The connector according to claim 1, wherein the first housing has a fitting hole on an outward-facing surface thereof, and the turning portion is formed near the fitting hole.

6. The connector according to claim 1, wherein the coupling portion comprises:

a first neighboring portion near the contacting portion;

a second neighboring portion near the terminal portion; and an intermediate portion between the first and the second neighboring portions, wherein the intermediate portion is narrower in width than the first and the second neighboring portions.

7. The connector according to claim 6, wherein each of the first and the second neighboring portions has opposite sides which define its width, and each of the opposite sides is rectilinear.

8. The connector according to claim 6, wherein each of the first and the second neighboring portions has opposite sides which define its width, and each of the opposite sides is curvilinear.

* * * * *